US007679478B2

(12) United States Patent
McCoy

(10) Patent No.: US 7,679,478 B2
(45) Date of Patent: Mar. 16, 2010

(54) LIGHTING CONTROL MODULE MECHANICAL OVERRIDE

(75) Inventor: Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 201 days.

(21) Appl. No.: 11/827,724

(22) Filed: Jul. 13, 2007

(65) Prior Publication Data

US 2008/0042787 A1 Feb. 21, 2008

Related U.S. Application Data

(60) Provisional application No. 60/830,532, filed on Jul. 13, 2006.

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 73/12*** | (2006.01) |
| ***H01H 3/00*** | (2006.01) |

(52) U.S. Cl. ..... 335/185; 335/17; 335/8; 335/10

(58) Field of Classification Search ..... 200/306, 200/400; 335/6, 8, 10, 11, 14, 17, 185
See application file for complete search history.

(56) References Cited

U.S. PATENT DOCUMENTS

| | | | | |
|---|---|---|---|---|
| 2,703,827 | A * | 3/1955 | Gelzheiser | 200/18 |
| 3,646,487 | A * | 2/1972 | Brackett, Sr. | 335/8 |
| 3,786,380 | A * | 1/1974 | Harper | 335/9 |
| 3,840,833 | A * | 10/1974 | Mrenna et al. | 337/43 |
| 4,080,582 | A * | 3/1978 | Link | 335/37 |
| 4,808,952 | A * | 2/1989 | Berner et al. | 335/41 |
| 4,816,792 | A * | 3/1989 | Belbel et al. | 335/14 |
| 5,821,876 | A * | 10/1998 | Farrington et al. | 340/3.2 |
| 6,104,265 | A * | 8/2000 | Maloney et al. | 335/13 |
| 6,531,938 | B1 * | 3/2003 | Smith et al. | 335/14 |
| 6,570,269 | B2 * | 5/2003 | McMillan et al. | 307/64 |
| 6,787,937 | B2 * | 9/2004 | Mody et al. | 307/115 |
| 6,888,431 | B2 * | 5/2005 | Jordan | 335/20 |
| 2002/0079992 | A1 * | 6/2002 | Yamagata et al. | 335/17 |
| 2003/0193381 | A1 * | 10/2003 | Davidson et al. | 335/14 |
| 2004/0217834 | A1 * | 11/2004 | Morita et al. | 335/220 |
| 2004/0257183 | A1 * | 12/2004 | Fello et al. | 335/172 |

* cited by examiner

*Primary Examiner*—Elvin G Enad
*Assistant Examiner*—Alexander Talpalatskiy
(74) *Attorney, Agent, or Firm*—Jose de la Rosa

(57) ABSTRACT

A switching device for selectively switching electrical power from an electrical power source to a load circuit comprises a housing. An electromechanical actuator is in the housing. A fixed contact is fixedly mounted in the housing. A contact arm is pivotally mounted in the housing. The contact arm carries a movable contact and has a lever. The contact arm is operatively connected to the actuator to be selectively positioned thereby for selectively electrically contacting the moveable contact with the fixed contact. A rotational actuator is rotationally mounted to the housing. The rotational actuator includes a leg proximate the lever so that rotational movement of the rotational actuator pivotally moves the contact arm to override the electromechanical actuator.

14 Claims, 7 Drawing Sheets

LIGHTING CONTROL MODULE MECHANICAL OVERRIDE

CROSS REFERENCE TO RELATED APPLICATIONS

This application claims priority of provisional application No. 60/830,532 filed Jul. 13, 2006, the contents of which is incorporated by reference herein.

FIELD OF THE INVENTION

This invention relates generally to residential and commercial electrical power distribution panels and components, and more particularly, to a mechanical override for a control module for controlling loads, particularly lighting loads and air conditioning loads, in an electrical power distribution system.

BACKGROUND OF THE INVENTION

Circuit breaker panels are used to protect electrical circuitry from damage due to an overcurrent condition, such as an overload, a relatively high level short circuit, or a ground fault condition. To perform that function, circuit breaker panels include circuit breakers that typically contain a switch unit and a trip unit. The switch unit is coupled to the electrical circuitry (i.e., lines and loads) such that it can open or close the electrical path of the electrical circuitry. The switch unit includes a pair of separable contacts per phase, a pivoting contact arm per phase, an operating mechanism, and an operating handle.

In the overcurrent condition, all the pairs of separable contacts are disengaged or tripped, opening the electrical circuitry. When the overcurrent condition is no longer present, the circuit breaker can be reset such that all the pairs of separable contacts are engaged, closing the electrical circuitry.

In addition to manual overcurrent protection via the operating handle, automatic overcurrent protection is also provided via the trip unit. The trip unit, coupled to the switch unit, senses the electrical circuitry for the overcurrent condition and automatically trips the circuit breaker. When the overcurrent condition is sensed, a tripping mechanism included in the trip unit actuates the operating mechanism, thereby disengaging the first contact from the second contact for each phase. Typically, the operating handle is coupled to the operating mechanism such that when the tripping mechanism actuates the operating mechanism to separate the contacts, the operating handle also moves to a tripped position.

Switchgear and switchboard are general terms used to refer to electrical equipment including metal enclosures that house switching and interrupting devices such as fuses, circuit breakers and relays, along with associated control, instrumentation and metering devices. The enclosures also typically include devices such as bus bars, inner connections and supporting structures (referred to generally herein as "panels") used for the distribution of electrical power.

In addition to electrical distribution and the protection of circuitry from overcurrent conditions, components have been added to panels for the control of electrical power to loads connected to circuit breakers. For example, components have been used to control electrical power for lighting.

One system used for controlling electrical power to loads utilizes a remote-operated circuit breaker system. In such a system, the switch unit of the circuit breaker operates not only in response to an overcurrent condition, but also in response to a signal received from a control unit separate from the circuit breaker. The circuit breaker is specially constructed for use as a remote-operated circuit breaker, and contains a motor for actuating the switch unit.

In an exemplary remote-operated circuit breaker system, a control unit is installed on the panel and is hard-wired to the remote-operated circuit breaker through a control bus. When the switch unit of the circuit breaker is to be closed or opened, an operating current is applied to or removed from the circuit breaker motor directly by the control panel. Additionally, separate conductors are provided in the bus for feedback information such as contact confirmation, etc., for each circuit breaker position in the panel. The control unit contains electronics for separately applying and removing the operating current to the circuit breakers installed in particular circuit breaker positions in the panel. The panel control unit also has electronics for checking the state of the circuit breaker, diagnostics, etc. One advantage of that system is that the individual circuit breakers can be addressed according to their positions in the panel.

As an alternative, a remote operated switching device can be provided as a discrete component for connection to a circuit breaker. Advantageously, a remote operated switching device performs numerous functions besides the basic switching operation. For example, it may be desirable to provide an indication as to the status of the switching device. Also, it may be necessary to provide a manual override for operating the switching device for trouble shooting or the like. The addition of such features can require numerous parts associated with operation of a movable contact. Moreover, related components such as bias springs, armature plates and the like, are required, as well as means for providing electrical terminations. All of this must advantageously be accomplished in a relatively small housing. At the same time, the contact structure must be capable of handling a current range of 15 to 50 amperes.

The present invention is directed to an improved mechanical override in a switching device.

SUMMARY OF THE INVENTION

In accordance with the invention, there is provided a mechanical override in a switching device in an electrical power distribution system.

In accordance with one aspect of the invention, there is provided a switching device for selectively switching electrical power from an electrical power source to a load circuit comprising a housing. An electromechanical actuator is in the housing. A fixed contact is fixedly mounted in the housing. A contact arm is pivotally mounted in the housing. The contact arm carries a movable contact and has a lever. The contact arm is operatively connected to the actuator to be selectively positioned thereby for selectively electrically contacting the moveable contact with the fixed contact. A rotational actuator is rotationally mounted to the housing. The rotational actuator includes a leg proximate the lever so that rotational movement of the rotational actuator pivotally moves the contact arm to override the electromechanical actuator.

It is a feature of the invention that the rotational actuator comprises a head externally accessible relative to the housing.

It is another feature of the invention that the head comprises a slotted head.

It is another feature of the invention that an operating spring is disposed between the housing and the contact arm to bias the switching device contacts to a closed position and wherein actuation of the electromechanical actuator selectively separates the contacts. The rotational actuator moves the contact arm to the closed position.

It is still another feature of the invention that the contact arm comprises an elongate bar having a turn defining opposite first and second legs. The contact arm is pivotally mounted in the housing proximate the turn, the first leg including the moveable contact for selectively electrically contacting the fixed contact, and the second leg including the lever.

There is disclosed in accordance with another aspect of the invention a control module for selectively switching electrical power from an electrical power source to a load circuit comprising a housing. An electromechanical actuator in the housing has a moveable plunger. A fixed contact is fixedly mounted in the housing. A contact arm in the housing comprises an elongate bar having a pivot defining opposite first and second legs. The first leg is operatively connected to the plunger to be selectively positioned thereby and includes a moveable contact for selectively electrically contacting the fixed contact. The second leg includes a lever. A rotational actuator is rotationally mounted to the housing. The rotational actuator includes a leg proximate the lever so that rotational movement of the rotational actuator pivotally moves the contact arm to override the electromechanical actuator.

Further features and advantages of the invention will be readily apparent from the specification and the drawings.

DETAILED DESCRIPTION OF THE INVENTION

An electrical distribution system, such as an integrated lighting control system, in accordance with the invention permits a user to control power circuits typically used for lighting, as well as circuits for resistive heating or air conditioning, using multipole remote operated relays. The electrical distribution system may be as is generally described in U.S. application Ser. No. 11/519,727, filed Sep. 12, 2006, the specification of which is incorporated by reference herein, or as is more specifically described in U.S. application Ser. No. 11/635,299, filed Dec. 7, 2006, the specification of which is incorporated by reference herein.

Figure 1:
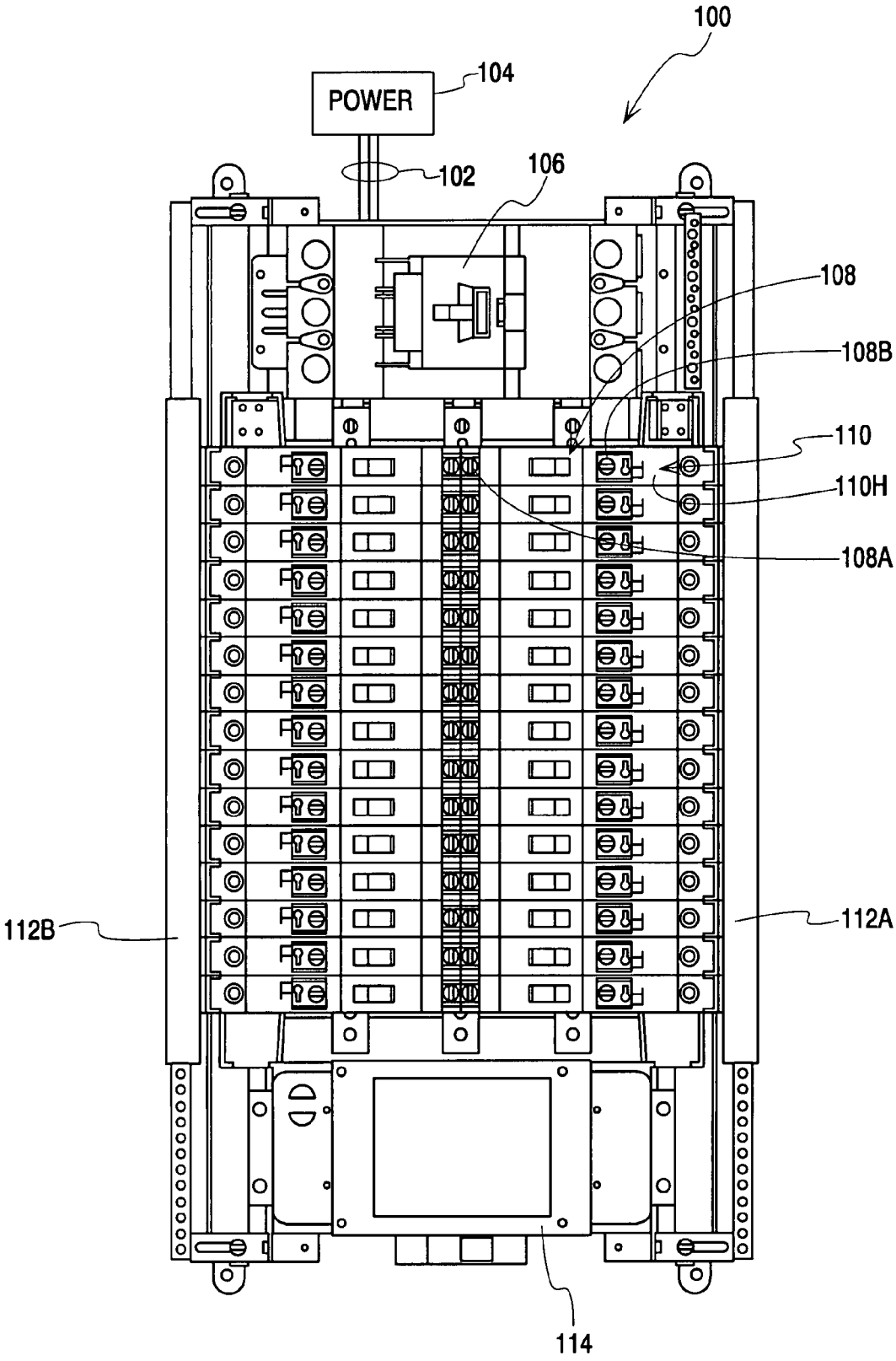
FIG. 1 is an elevation view of a power distribution panel according to the invention.

Referring to FIG. 1, a lighting control system in accordance with the invention comprises a lighting control panel 100. The panel 100 may comprise a Siemens type P1 panelboard, although the invention is not limited to such a configuration. Line power enters the panel 100 through power source cables 102 connected to a source of power 104. Line power may, for example, be a three phase 480Y277, 240 or 120 VAC power source, as is conventional. The cables 102 are electrically connected to an input side of a main breaker 106. The main breaker 106 distributes line power to individual circuit breakers 108 in a conventional manner. How the power is distributed depends on design of the individual circuit breakers 108, as will be apparent to those skilled in the art. The power is distributed to the line side of individual circuit breakers 108. The panel 100 may be configured to accept forty two or more individual circuit breakers 108, although only thirty are shown in the embodiment of FIG. 1. Each circuit breaker may be of conventional construction and may be, for example, a Siemens BQD circuit breaker. Each circuit breaker 108 includes a line terminal 108A receiving power from the main breaker 106 and a load terminal 108B conventionally used for connecting to a load circuit.

For simplicity of description, when a device such as a circuit breaker 108 is described generally herein the device is referenced without any hyphenated suffix. Conversely, if a specific one of the devices is described it is referenced with a hyphenated suffix, such as 108-1.

In accordance with the invention, each load circuit to be controlled also has a remote operated device or control module 110, in the form of a relay, a meter or a dimmer. The term remote operated device as used herein includes any other devices that controls, monitors or may otherwise be used in a load circuit, in accordance with the invention. While in a preferred embodiment, the remote operated device 110 is a separate component from the circuit breaker 108, the term "remote operated device" as used herein encompasses devices integral with the circuit breaker. The remote operated devices 110 are also connected to data rails 112A and 112B. A panel controller 114 controls the remote operated devices 110 through connections provided via the data rails 112A and 112B, as discussed below.

The remote operated device 110, in the form of a relay embodiment, includes a housing 110H encasing an auxiliary set of contacts that can be remotely operated to open and close a lighting circuit. The device 110 is attached to the load side of a circuit breaker 108 within a panel 100 using a conductor tab, i.e, the terminal 110A, inserted into the breaker lug 108B, see FIG. 2. The load terminal 110B comprises a lug of the same size as the breaker lug 108B for connecting to a wire to be connected to the load device. The device housing 110H is configured to mount in a Siemens type P1 panelboard, although the invention is not limited to such a configuration.

Figure 2:
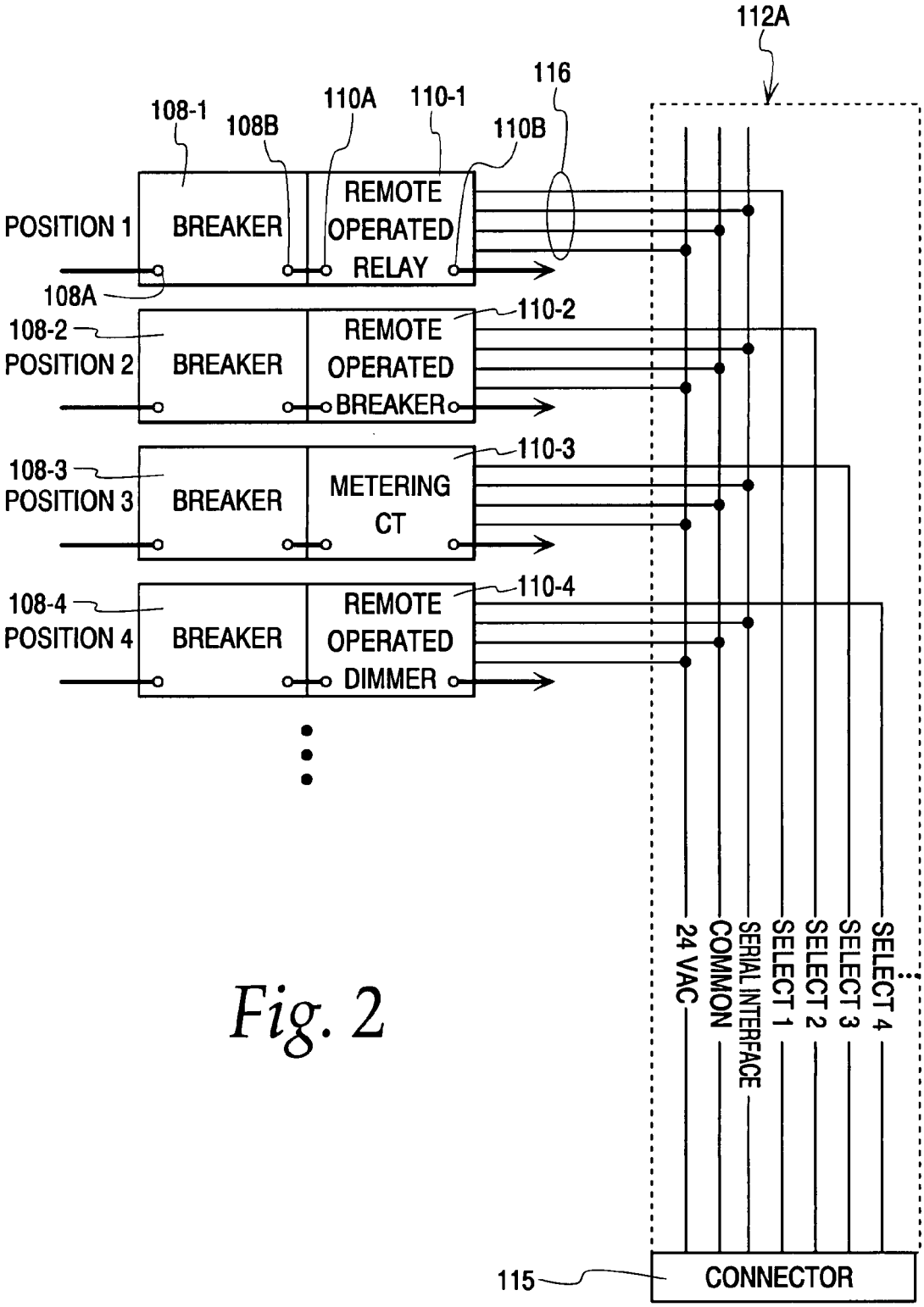
FIG. 2 is a block diagram illustrating pairs of circuit breakers and remote operated devices of the power distribution panel of FIG. 1.

Referring to FIG. 2, a block diagram illustrates four circuit breakers 108-1, 108-2, 108-3 and 108-4, and respective associated remote operated devices 110-1, 110-2, 110-3 and 110-4. In the illustrated embodiment, the first device 110-1 comprises a relay, the second device 110-2 comprises a breaker, the third device 110-3 comprises a current transformer, and the fourth device 110-4 comprises a dimmer. As is apparent, any combination of these remote operated devices 110 could be used. Each remote operated device 110 includes an input terminal 110A electrically connected to the associated circuit breaker load terminal 108B, and an output terminal 110B for connection to a load device.

The data rail 112 is mechanically attached directly to the interior of the lighting control panel 100. The data rail 112 comprises a shielded communication bus including a ribbon connector 115 having conductors to be routed to the panel controller 114. A cable 116 connects the data rail 112 to the remote operated device 110.

A detailed description of the data rail 112 and panel controller 114 are not provided herein. Instead, reference may be made to the detailed discussion of the same in the applications incorporated by reference herein. Indeed, the present invention does not require use of either a panel controller or data rail, as will be apparent.

The remote operated device 110, in the form of a relay, allows remote switching of an electrical branch load. The device 110 is designed to fit inside a standard electrical panel board with forty-two or more branch circuit breakers 108. The device 110 is an accessory to a branch circuit breaker 108 allowing repetitive switching of the load without effecting operation of the circuit breaker 108.

The remote operator device 110 requires a means to receive command signals to open or close and to report back successful operation or device status. Also required is a means to drive opening and closing of the switch mechanism contacts. With this design, electronic control circuitry is located inside the switching device itself. The use of a magnetically held solenoid or "maglatch" as a switching actuator results in very low energy requirements, requires short duration pulses to change position (measured in milliseconds), provides accurate and repeatable timing and requires that the control must reverse voltage polarity.

Figure 3:
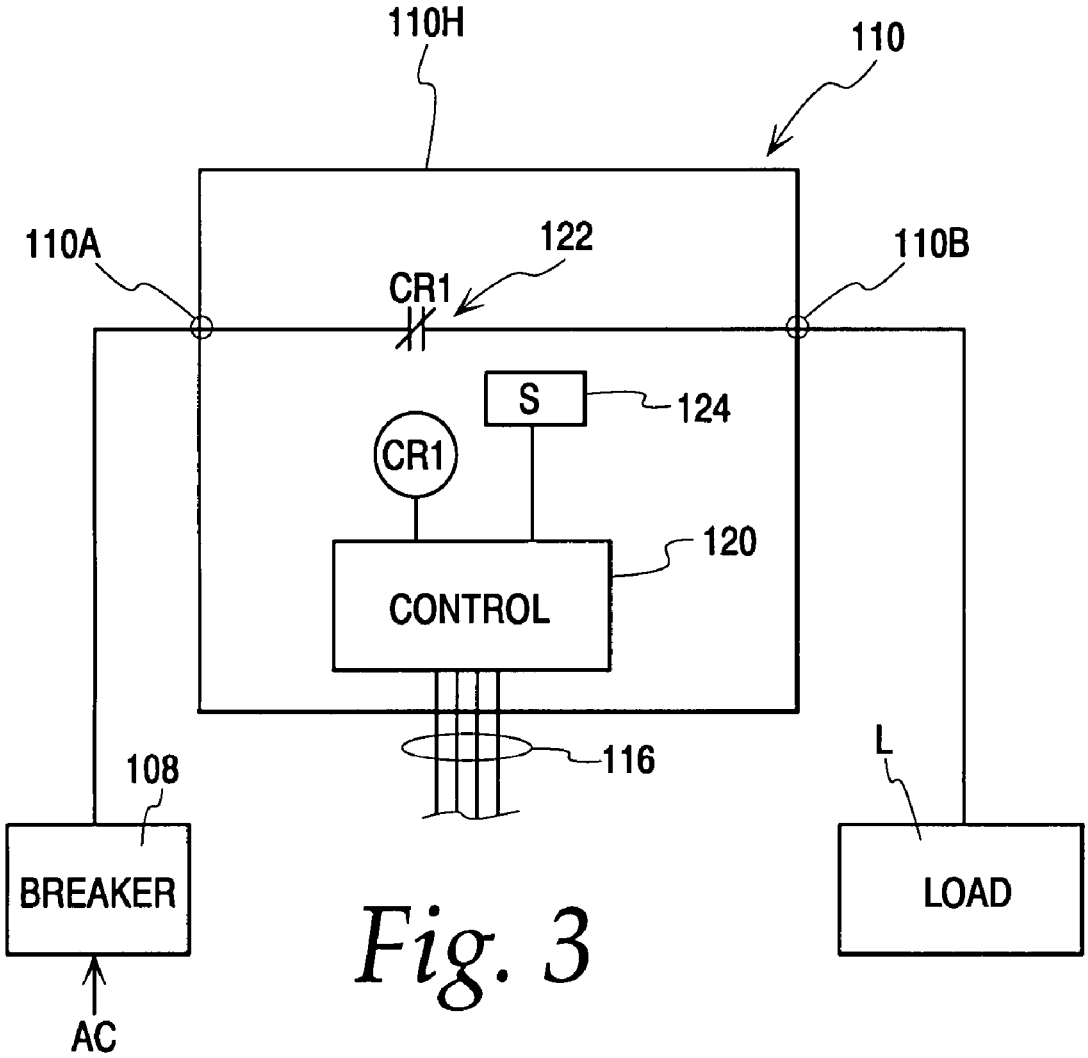
FIG. 3 is a basic block diagram of a remote operated control module in accordance with the invention.

FIG. 3 illustrates a basic block diagram for load switching. The remote operated device 110, in the form of a relay, includes a control circuit 120 connected to the cable 116. The control circuit 120 drives a control relay CR having a normally closed contact 122 connected between terminals 110A and 110B. A sensor 124 senses status of the relay CR and is connected to the control circuit 120. As such, the control circuit 120 controls operation of the contact 122 to selectively electrically connect a load L to the breaker 108, and thus to power the load L.

The control circuit 120 comprises a conventional microcontroller and associated memory, the memory storing software to run in the control circuit 120 in accordance with commands received from the panel controller 114.

Figure 5:
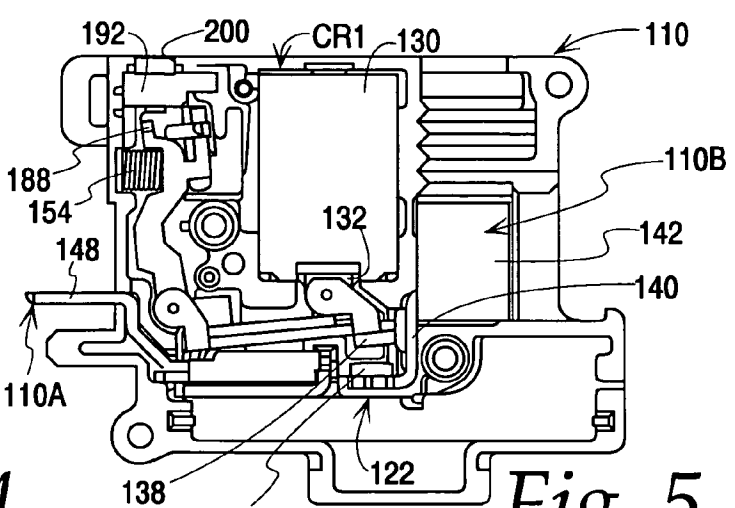
FIG. 5 is an elevation view, similar to FIG. 4, showing the contact in an open position.
Figure 4:
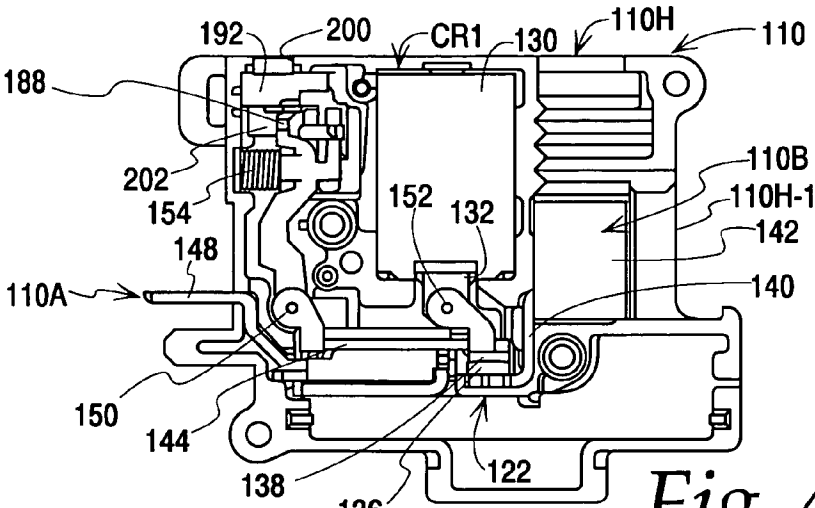
FIG. 4 is an elevation view of the control module with one part of the housing removed for clarity and showing a contact in a closed position.
Figure 12:
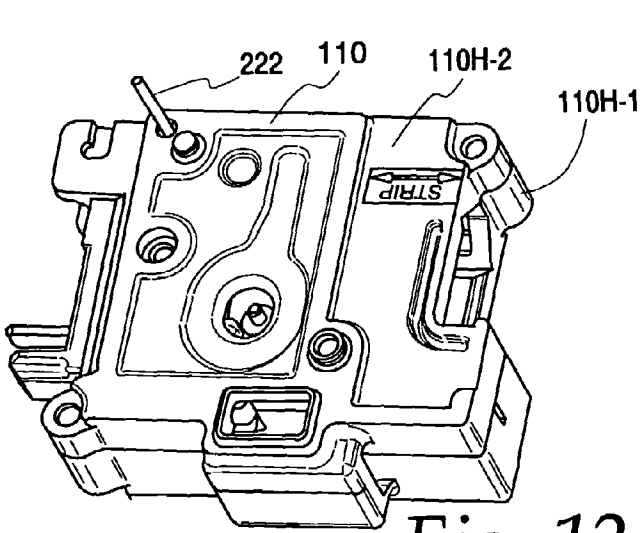
FIG. 12 is a perspective view of a first control module of the two pole switching device of FIG. 11 with a push rod extending therefrom.

Referring to FIGS. 4 and 5, the control module 110 is illustrated in greater detail. The control module housing 110H comprises a two piece housing with a first housing piece 110H-1 shown and with a second housing piece 110H-2, see FIG. 12, removed to illustrate internal components. The two housing pieces 110H-1 and 110H-2 are held together by fasteners, not shown, to form the housing 110H.

The control relay CR1, see FIG. 3, comprises a magnetically held solenoid including a maglatch actuator coil 130 operating an actuator plunger 132. The coil 130 is controlled by the control circuit 120, see FIG. 3. An open signal causes the drive circuit to apply negative voltage to the actuator coil 130 for a short period of time (about 10 to 30 milliseconds). This causes the actuator plunger 132 to pull in and become magnetically latched or held to open the contact 122, described more specifically below, in a conventional manner. A close signal from the drive circuit applies a positive voltage to the actuator coil 130 for a shorter period of time (about 2 to 3 milliseconds). This period of time is sufficient for the actuator plunger 132 to become unlatched or release. Power is then removed from the coil 130. Since the actuator plunger 132 is stable in both the open and closed positions, energy is only required to change position.

The electrical switch normally closed 122, see FIG. 3, comprises a fixed contact 136 and a movable contact 138. The fixed contact 136 is mounted to a load terminal 140 connected to a lug 142 to define the terminal 110B. The movable contact 138 is mounted to a contact arm 144. A braid 146, see FIG. 8, couples the contact arm 144 to a line terminal 148 to provide the conductor tab terminal 110A for connection to the circuit breaker, as discussed above.

The contact arm 144 is pivotally mounted in the housing 110H with a pivot pin 150. A wrist pin 152 connects the contact arm 144 to the plunger 132. An operating spring 154 biases the contact arm 144 so that normally the movable contact 138 is in electrical contact with the fixed contact 136, as shown in FIG. 4. This is the normally closed state of the contact 122. When the solenoid 130 is latched, the plunger 132 raises the contact arm 144 via the wrist pin 152 to space the movable contact 138 from the fixed contact 136, as shown in FIG. 5. This is the open position of the contact 122.

More particularly, the basic operation of the control module 110 is to be able to turn lights (or other electrical devices) On or Off remotely. The operating spring 154 pushes the contact arm 144 toward the closed position. The maglatch coil 130 is a solenoid that has a permanent magnet. So if the contact 122 is are open, the plunger 132 of the maglatch coil 130 is retracted and the permanent magnet within the maglatch coil 130 holds the contact 122 open. The permanent magnet is stronger than the force of the operating spring 154 that is pushing the against the contact arm 144. To close the contact 122, a signal is sent to the maglatch coil 130 that temporarily disrupts the field of the permanent magnet within the maglatch coil 130 and this allows the operating spring 154 to close the contact 122. Once the contact 122 is in the closed position, the force of the operating spring is greater than the force of the permanent magnet within the maglatch coil 130 because the plunger 132 is positioned away from the permanent magnet. To open the contact 122, a signal is sent to the maglatch 130 to retract the plunger 132 back to the retracted position where the permanent magnet holds the contact 122 open.

Figure 7:
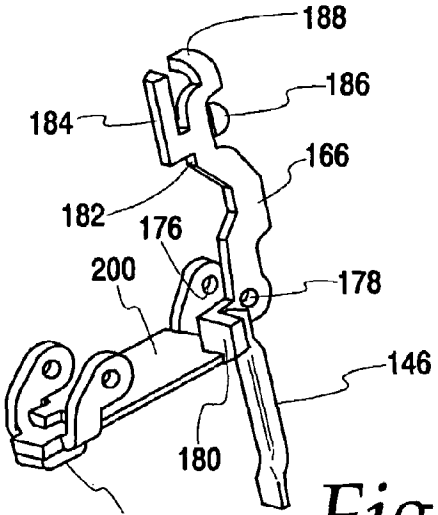
FIG. 7 is a perspective view illustrating various components secured to the contact arm.
Figure 8:
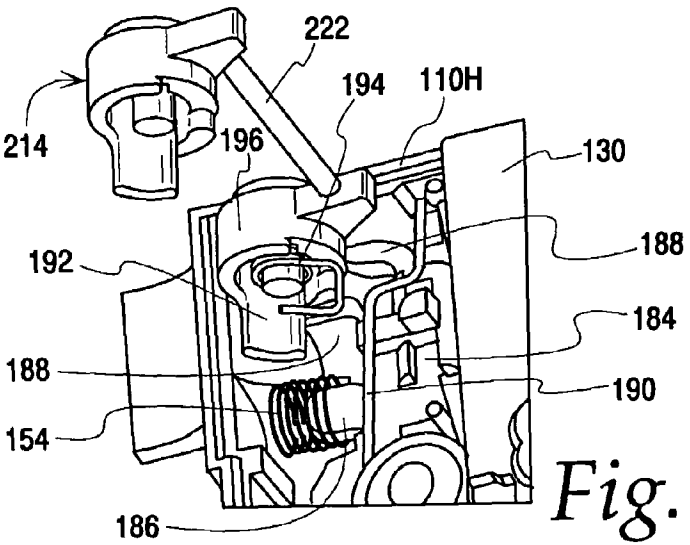
FIG. 8 is a cutaway, perspective view illustrating a mechanical override in the control module in accordance with the invention.
Figure 6:
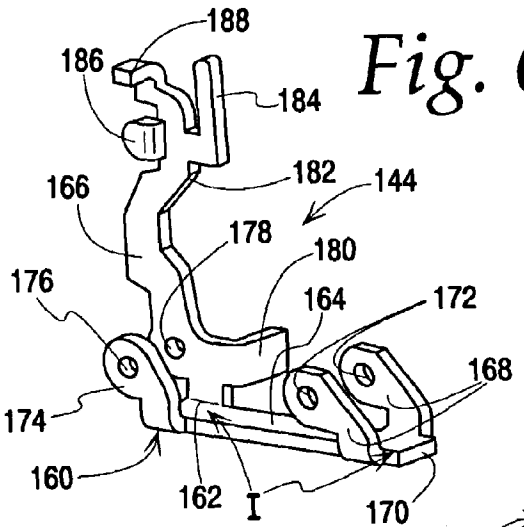
FIG. 6 is a perspective view of a contact arm of the control module in accordance with the invention.

Referring to FIG. 6, the contact arm 144 is illustrated. The contact arm is formed of a conductive material such as, for example, brass or copper, or the like. The contact arm 144 comprises an elongate bar 160 having a turn 162 defining a first leg 164 and a second leg 166. The first leg 164 defines a current path I. A pair of opposite protrusions 168 extend upwardly from a distal end 170 of the first leg 164 and include wrist pin holes 172 for receiving the wrist pin 152. A third protrusion 174 is provided at the first leg 164 proximate the turn 162 and includes a pivot hole 176 for receiving the pivot rod 150. Another pivot hole 178 is provided in the second leg 166. The second leg 166 includes a first tab 180 proximate the turn 162 for providing an electrical connection with the braid 146, as shown in FIG. 7. The movable contact 138 is affixed on the underside of the first leg distal end 170, as shown in FIG. 7. The braid 146 may be secured, as by welding or the like, to the tab 180. The second leg 166 includes a distal end 182 including an indicator mount tab 184, a spring mount tab 186 and an override interface lever 188. Referring also to FIG. 8, the operating spring 154 is captured on the spring mount 186 against the housing 110H to bias the contact arm 144, as discussed above.

Figure 9:
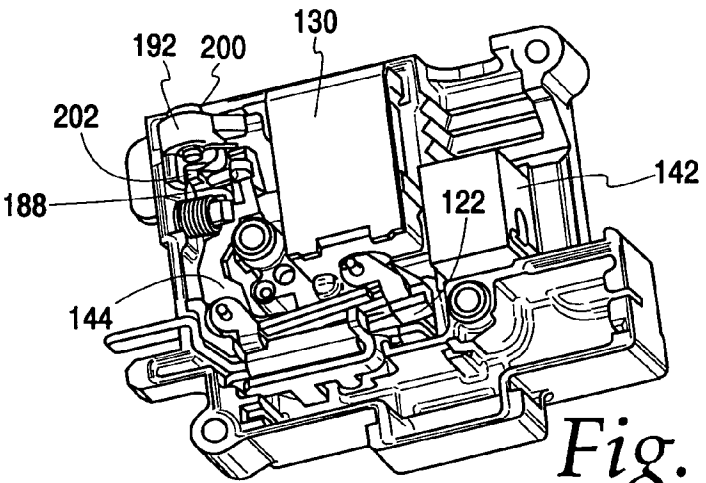
FIG. 9 is a perspective view of the control module with the electrical contact in the open position and the mechanical override in the neutral position.
Figure 10:
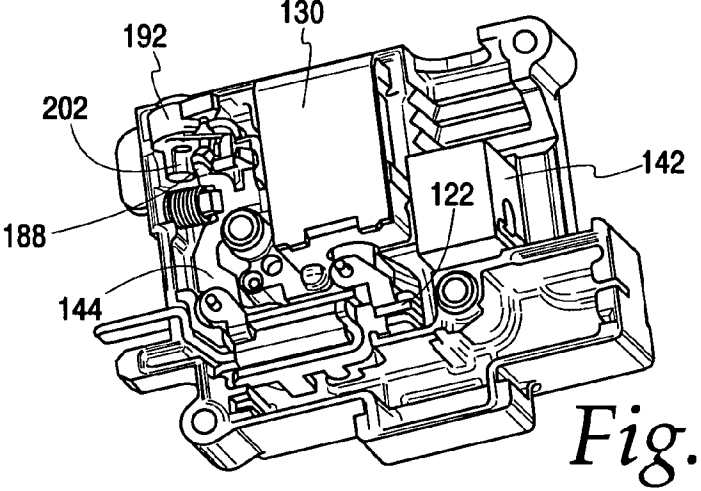
FIG. 10 is a perspective view, similar to FIG. 9, illustrating the mechanical override in the override position and the electrical contact in the closed position.

In accordance with the invention, an override knob in the form of a rotational actuator 192 is rotationally mounted in the housing 110H and is biased by a spring 194. The rotational actuator 192 comprises a cylindrical head 196 having a slot, such as shown at 198 in FIG. 13. The head 196 extends through an opening 200 in the housing 110H. A leg 202 extends downwardly from the head 196 and is positioned proximate the lever 188. The knob 192 can be rotated clockwise, such as by a screwdriver. Once the head 196 starts to turn the leg 202 hits the lever 188 on the contact arm 144. When the head 186 is turned further, it moves the contact arm 144 enough to cause the operating spring 154 to force the contact arm 144 to the closed position to override the coil 130. FIG. 9 illustrates the knob 192 in the normal position with the contact 122 open. FIG. 10 illustrates the knob 192 rotated to the override position with the contact 122 closed.

The mechanical override in accordance with the invention can also be used with multipole devices. Such multipole devices provide multiple sets of switching contacts for the control of air conditioning or meter loads, or the like.

FIGS. 11-14 illustrate a two pole switching device 208 including the control module 110 as a first pole and a second pole control module 210. The two control modules 110 and 210 are generally similar to one another. Thus the second control module 210 is not described in detail. One difference is that the control circuit 120 of the first pole control module 110 also operates a maglatch coil 212 for the second pole control module 210. Also, a tie bar (not shown) may be included for mechanically linking the moveable contacts.

Figure 13:
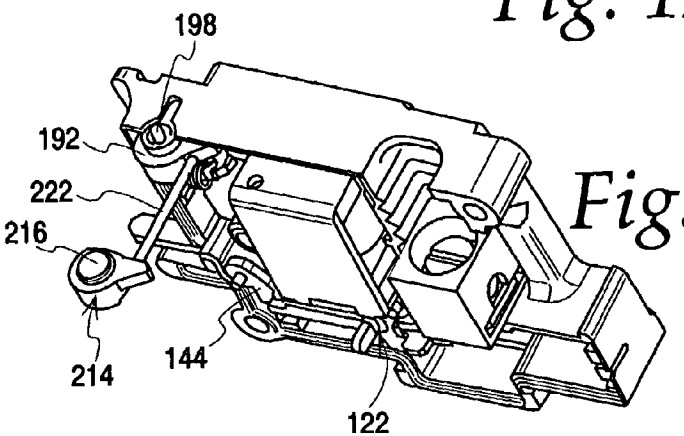
FIG. 13 is a perspective view of the first control module of the two pole switching device of FIG. 11 with a push rod connected to a mechanical override of the second control module and the mechanical override in the neutral position.
Figure 11:
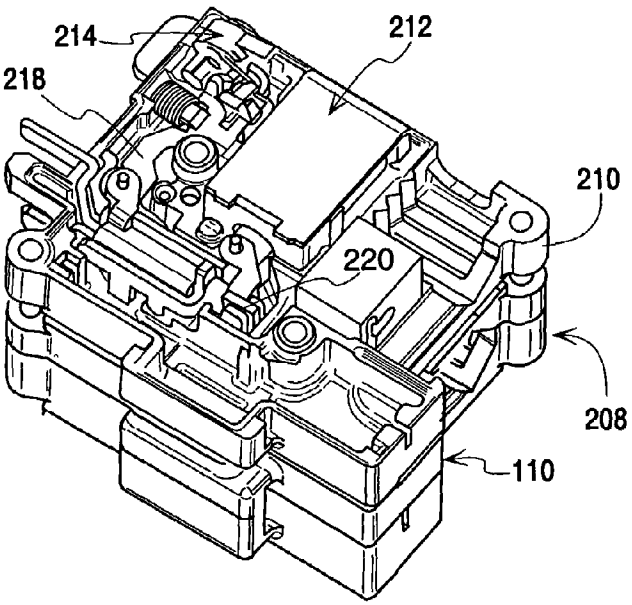
FIG. 11 is a perspective view illustrating a two pole switching device including a mechanical override in accordance with the invention.
Figure 14:
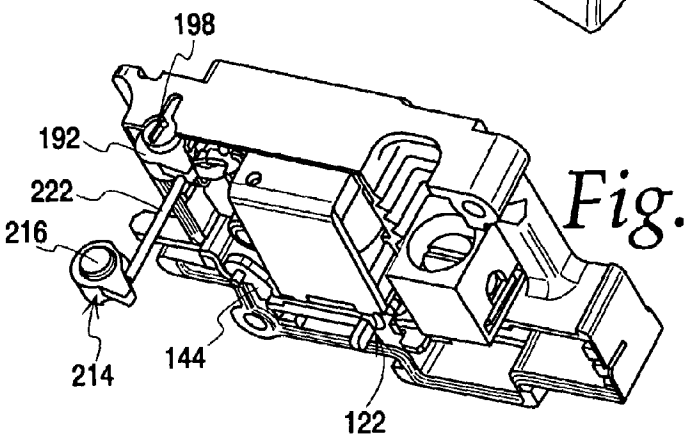
FIG. 14 is a perspective view, similar to FIG. 13, with the mechanical override in the override position.

The first control module 110 includes the override knob or rotational actuator 192 having the slotted head 198 as discussed above. Rotation of the override knob 192 moves the associated contact arm 144 to close the contact 122, as described above. The second control module 210 includes an override knob or rotational actuator 214 having a plane head 216. Other than the plane head 216, the second pole override knob 214 is identical in structure and function to the first pole override knob 192, as described above. Rotation of the override knob 214 moves an associated contact arm 218 to close a contact 220, as above. A push rod 222 extends between the control modules 110 and 210 to mechanically link the override knobs 192 and 214. The first pole override knob 192 drives the second pole override knob 214. Particularly, the push rod 222 causes the second pole control module override knob 214 to rotate when the first pole control knob override knob 192 is turned. As such, rotation of the first pole override knob 192 causes the respective contacts 122 and 220 of both poles 110 and 210 to close. FIG. 13 illustrates the knobs 192 and 214 in the normal position. FIG. 14 illustrates the knobs 192 and 214 rotated to the override position.

Figure 15:
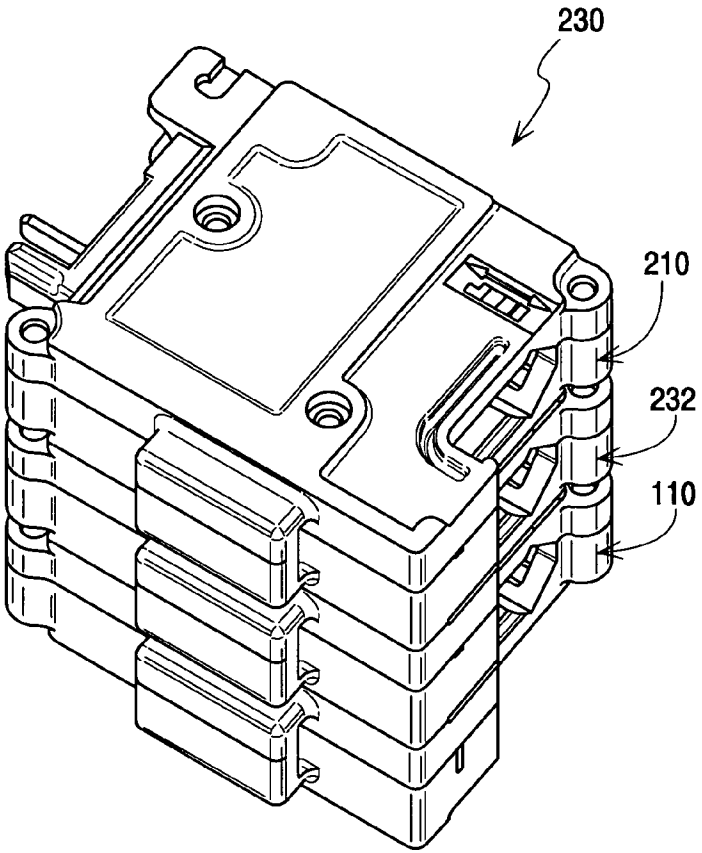
FIG. 15 is a perspective view of a three pole switching device including the mechanical override in accordance with the invention.
Figure 16:
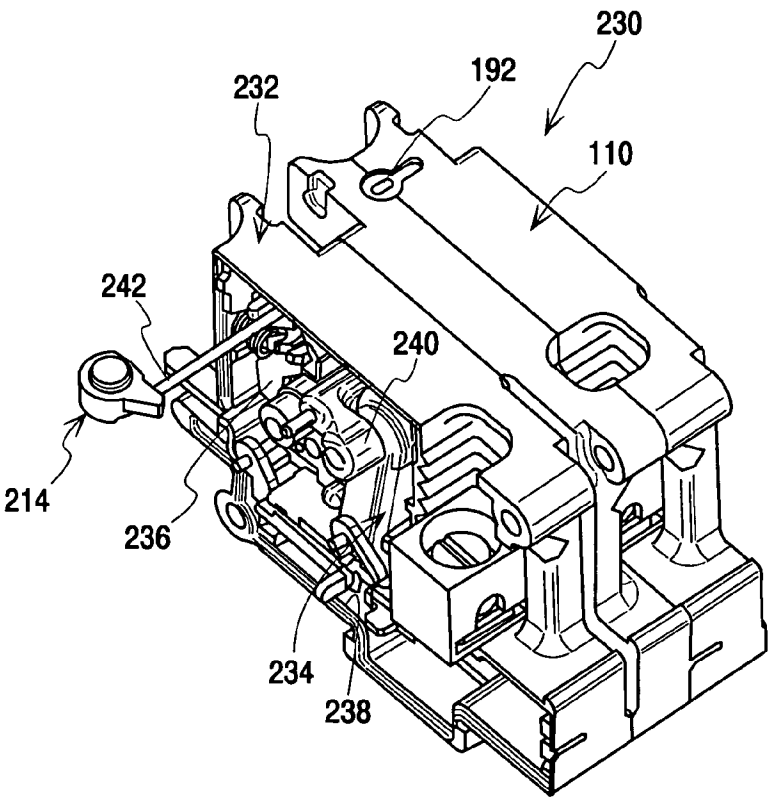
FIG. 16 is a perspective view of the three pole switching device with parts removed for clarity illustrating the push rod and a mechanical override of the third pole.

FIGS. 15 and 16 illustrate a three pole switching device 230 including the control module 110 as a first pole, the control module 210 as a second pole and a control module 232 as a third pole. The third pole control module 232 is between the first and second pole control modules 110 and 210, respectively. The third pole control module 232 differs in that the coil is replaced with a mechanical actuator 234. The mechanical actuator 234 operates a control arm 236 to control a contact 238. Otherwise, contact operation is similar to that with the control modules 110 and 210. Although not shown in detail, a tie bar 240 is connected between the mechanical actuator 234 and plungers of the Maglatch coils 130 and 212 of the first and second pole control modules 110 and 210. The third pole control module 232 does not include an override knob. A push rode 242 extends between the control modules 110 and 210 to mechanically link the override knobs 192 and 214. The push rod 242 is one "pole width" longer than the push rod 222, discussed above. Since the third pole control module does not include a maglatch coil, an override knob is not required. Instead, the first pole override knob 192 drives the second pole override knob 214, as above. The override function to close the contact 238 in the third pole control module 232 is implemented through the mechanical linkage provided by the tie bar 240 and the mechanical actuator 234, as is apparent.

Thus, in accordance with the invention, there is provided a mechanical override for a movable contact in a control module.

The general configuration of the control modules 110 is presented by way of example. The mechanical override in accordance with the invention could be used with other configurations of relays or control modules adapted to form a switching device. While the disclosed configuration is advantageously used in a distribution panel, the mechanical override could similarly be used with stand-alone devices or the like.

I claim:

1. A switching device for selectively switching electrical power from an electrical power source to a load circuit comprising:

a housing;

an electromechanical actuator comprising a permanent magnet in the housing;

a fixed contact fixedly mounted in the housing;

a contact arm pivotally mounted in the housing, the contact arm carrying a movable contact and having a lever, the contact arm being operatively connected to the actuator to be selectively positioned thereby for selectively electrically contacting the moveable contact with the fixed contact, the permanent magnet being operable to hold the contact arm in a position such that the moveable contact is separate from the fixed contact;

a rotational actuator rotationally mounted to the housing, the rotational actuator including a leg proximate the lever so that rotational movement of the rotational actuator pivotally moves the contact arm to override the electromechanical actuator; and an operating spring disposed between the housing and the contact arm to bias the switching device contacts to a closed position and wherein actuation of the electromechanical actuator selectively separates the contacts and the rotational actuator, when manually turned to an override position, overrides the electromechanical actuator and moves the contact arm to the closed position.

2. The switching device of claim 1 wherein the rotational actuator comprises a head externally accessible relative to the housing.

3. The switching device of claim 2 wherein the head comprises a slotted head.

4. The switching device of claim 1 wherein the contact arm comprises an elongate bar having a turn defining opposite first and second legs, the contact arm being pivotally mounted in the housing proximate the turn, the first leg including the moveable contact for selectively electrically contacting the fixed contact, and the second leg including the lever.

5. A control module for selectively switching electrical power from an electrical power source to a load circuit comprising:

a housing;

an electromechanical actuator comprising a permanent magnet in the housing having a moveable plunger;

a fixed contact fixedly mounted in the housing;

a contact arm in the housing comprising an elongate bar having a pivot defining opposite first and second legs, the first leg being operatively connected to the plunger to be selectively positioned thereby and including a moveable contact for selectively electrically contacting the fixed contact, and the second leg including a lever, the permanent magnet being operable to hold the contact arm in a position such that the moveable contact is separate from the fixed contact;

a rotational actuator rotationally mounted to the housing, the rotational actuator including a leg proximate the lever so that rotational movement of the rotational actuator pivotally moves the contact arm to override the electromechanical; and an operating spring disposed between the housing and the contact arm to bias the switching device contacts to a closed position and wherein actuation of the electromechanical actuator selectively separates the contacts and the rotational actuator, when manually turned to an override position, overrides the electromechanical actuator and moves the contact arm to the closed position.

6. The control module of claim 5 wherein the rotational actuator comprises a head externally accessible relative to the housing.

7. The control module of claim 6 wherein the head comprises a slotted head.

8. A multipole switching device for selectively switching electrical power from an electrical power source to a load circuit comprising:

first and second control modules, each comprising a housing, an electromechanical actuator comprising a permanent magnet in the housing having a moveable plunger, a fixed contact fixedly mounted in the housing, and a contact arm in the housing comprising an elongate bar having a pivot defining opposite first and second legs, the first leg being operatively connected to the plunger to be selectively positioned thereby and including a moveable contact for selectively electrically contacting the fixed contact, and the second leg including a lever, and a rotational actuator rotationally mounted to the housing, the rotational actuator including a leg proximate the lever so that rotational movement of the rotational actuator pivotally moves the contact arm to override the electromechanical actuator, the permanent magnet being operable to hold the contact arm in a position such that the moveable contact is separate from the fixed contact wherein each control module further comprises an operating spring disposed between the housing and the contact arm to bias the switching device contacts to a closed position and wherein actuation of the electromechanical actuator selectively separates the contacts and each rotational actuator moves the associated contact arm to the closed position; and a push rod mechanically linking the rotational actuators, when manually turned to an override position, overrides the electromechanical actuator and of the first and second control modules.

9. The multipole switching device of claim 8 wherein each rotational actuator comprises a head externally accessible relative to the associated housing.

10. The multipole switching device of claim 9 wherein the head of the first control module comprises a slotted head.

11. The multipole switching device of claim 8 further comprising a third control module disposed between the first and second control modules, the third control module comprising a housing, a mechanical actuator in the housing driven by the first and second control modules, a fixed contact fixedly mounted in the housing, and a contact arm in the housing comprising an elongate bar having a pivot defining opposite first and second legs, the first leg being operatively connected to the mechanical actuator to be selectively positioned thereby and including a moveable contact for selectively electrically contacting the fixed contact.

12. The switching device of claim 1 wherein the electromechanical actuator is adapted to override the permanent magnet causing the contact arm to move to a second position in which the moveable contact contacts the fixed contact.

13. The control module of claim 5 wherein the electromechanical actuator is adapted to override the permanent magnet causing the contact arm to move to a second position in which the moveable contact contacts the fixed contact.

14. The multipole switching device of claim 8 wherein the electromechanical actuator is adapted to override the permanent magnet causing the contact arm to move to a second position in which the moveable contact contacts the fixed contact.

* * * * *